US011856370B2

(12) United States Patent
Ma et al.

(10) Patent No.: US 11,856,370 B2
(45) Date of Patent: Dec. 26, 2023

(54) SYSTEM FOR AUDIO RENDERING COMPRISING A BINAURAL HEARING DEVICE AND AN EXTERNAL DEVICE

(71) Applicant: GN Hearing A/S, Ballerup (DK)

(72) Inventors: Changxue Ma, Barrington, IL (US); Andrew Dittberner, Antioch, IL (US); Eugene Brandewie, Duluth, MN (US)

(73) Assignee: GN HEARING A/S, Ballerup (DK)

( * ) Notice: Subject to any disclaimer, the term of this patent is extended or adjusted under 35 U.S.C. 154(b) by 140 days.

(21) Appl. No.: 17/460,078

(22) Filed: Aug. 27, 2021

(65) Prior Publication Data

US 2021/0392448 A1 Dec. 16, 2021

(51) Int. Cl.
*H04R 25/00* (2006.01)
*H04S 7/00* (2006.01)

(52) U.S. Cl.
CPC ..... *H04R 25/552* (2013.01); *H04R 25/558* (2013.01); *H04S 7/301* (2013.01); *H04R 25/70* (2013.01); *H04R 2225/55* (2013.01); *H04S 2420/01* (2013.01)

(58) Field of Classification Search
CPC .... H04R 25/552; H04R 25/558; H04R 25/70; H04R 2225/55; H04S 7/301; H04S 2420/01
See application file for complete search history.

(56) References Cited

U.S. PATENT DOCUMENTS 11,457,308 B2 * 9/2022 Secall ..... H04S 1/002
2013/0322667 A1 * 12/2013 Christensen ..... G01C 21/3629 381/309
2016/0212272 A1 7/2016 Srinivasan et al.
(Continued)

FOREIGN PATENT DOCUMENTS

DK 2018 00462 10/2019
EP 2669634 12/2013
(Continued)

OTHER PUBLICATIONS

Extended European Search Report for EP Patent Appln No. 21199066.8 dated May 30, 2022.
(Continued)

*Primary Examiner* — Brian Ensey
(74) *Attorney, Agent, or Firm* — Vista IP Law Group, LLP

(57) ABSTRACT

An electronic device configured to communicate with a binaural hearing device, includes: a wireless communication unit configured to wirelessly receive, from the binaural hearing device, a signal indicating an orientation of a head of a user of the binaural hearing device; a memory storing head-related transfer functions (HRTF) respectively for a left ear and a right ear of the user; an input transducer configured to capture sound at a distance from the user; and a processing unit configured to provide a spatialized binaural audio signal based on the captured sound, the orientation of the head of the user, and the head-related transfer functions (HRTF); wherein the wireless communication unit is configured to transmit the spatialized binaural audio signal to the binaural hearing device for allowing the binaural hearing device to provide left and right audio outputs based on the spatialized binaural audio signal.

24 Claims, 5 Drawing Sheets

(56) References Cited

U.S. PATENT DOCUMENTS

| | | | |
|---|---|---|---|
| 2018/0262849 | A1 | 9/2018 | Farmani et al. |
| 2018/0324532 | A1 | 11/2018 | Kukla |
| 2021/0168553 | A1 | 6/2021 | Brown et al. |

FOREIGN PATENT DOCUMENTS

| | | | |
|---|---|---|---|
| EP | 2819437 | | 12/2014 |
| EP | 2871857 | | 5/2015 |
| EP | 3157268 | | 4/2017 |
| EP | 3422744 | A1 | 1/2019 |
| EP | 3468228 | | 4/2019 |
| EP | 3716642 | | 9/2020 |
| EP | 3873109 | | 9/2021 |
| WO | WO 2021/067183 | | 4/2021 |

OTHER PUBLICATIONS

Partial European Search Report for EP Patent Appln. No. 21199066.8 dated Mar. 17, 2022.
1st examination report for Danish patent application No. PA 202170469 dated Mar. 2, 2022.

* cited by examiner

SYSTEM FOR AUDIO RENDERING COMPRISING A BINAURAL HEARING DEVICE AND AN EXTERNAL DEVICE

FIELD

The present disclosure relates to a system for audio rendering. The system comprises a binaural hearing device configured to be worn by a user. The system comprises an external device configured to be arranged at a distance from the user, the external device comprising an input transducer for capturing sounds at the distance from the user.

BACKGROUND

Wireless streaming of audio to a hearing aid is one of the important aspects of the communication method for people with hearing loss. The audio can be captured by a remote microphone (mic) such as a spouse mic or a smartphone, etc. This mic acts as a close-talk mic, which can provide a clearer signal, with a much better signal-to-noise-ratio in a noisy environment.

However, there is a need for an improved system and method of using a hearing aid and a remote microphone.

SUMMARY

Disclosed is a system for audio rendering. The system comprises a binaural hearing device configured to be worn by a user. The system comprises an external device configured to be arranged at a distance from the user.

The binaural hearing device comprises one or more sensors for measuring the orientation of the user's head. The binaural hearing device comprises a first wireless communication unit for wireless communication with the external device, where the first wireless communication unit is configured for transmitting the orientation of the user's head to the external device.

The external device comprises a second wireless communication unit for wireless communication with the binaural hearing device, where the second wireless communication unit is configured for receiving the orientation of the user's head transmitted from the binaural hearing device.

The external device comprises a memory having stored pre-determined head-related transfer functions (HRTF) for the user's left ear and right ear, respectively.

The external device comprises a second input transducer for capturing sounds at the distance from the user.

The external device comprises a second signal processor for processing the captured sounds at the distance from the user, wherein the processing is based on the received orientation of the user's head and the pre-determined head-related transfer functions (HRTF) for the user's left ear and right ear for providing a spatialized binaural audio signal.

The second wireless communication unit is configured for transmitting the spatialized binaural audio signal to the binaural hearing device.

The binaural hearing device further comprises a left hearing device configured to be worn in/at the left ear of the user, the left hearing device comprising a left output transducer configured for providing output audio signals in the left ear of the user.

The binaural hearing device further comprises a right hearing device configured to be worn in/at the right ear of the user, the right hearing device comprising a right output transducer configured for providing output audio signals in the right ear of the user.

The first wireless communication unit of the binaural hearing device is configured for receiving the spatialized binaural audio signal transmitted from the external device.

The spatialized binaural audio signal is provided in the left output transducer and in the right output transducer of the binaural hearing device.

The proposed system consists of an external device, such as a remote device, such as a spouse mic or a smartphone, which can wirelessly stream a stereo audio signal to the hearing devices, such as hearing aids, of the binaural hearing device. The binaural hearing devices are worn by the hearing device user. The external device is in proximity to the hearing device user. The external device may be worn by a person, such as a spouse, and can be moved at will.

The advantage of one or more embodiments described herein is to provide a system and methods to virtualize streamed audio such that hearing device users can control the perceived spatial location of the remote sound objects and to improve the externalization of those sound objects.

Wireless streaming of audio to a hearing aid is one of the important aspects of the communication method for hearing loss people. The audio can be captured by a remote microphone (mic) such as a spouse mic or a smartphone, etc. This mic acts as a close-talk mic, which can provide a clearer signal, with a much better signal-to-noise-ratio in a noisy environment. However, in prior art, the perceived sound object from the streamed audio is typically rendered as a monaural sound source. This makes the sound object perceived in the center of the listener's head. In prior art, there are also no perceived movements of the sound object, even if the source of the streamed audio moves around within the environment. Experiments have showed that virtual sound objects whose position was fixed relative to the world are more likely to be externalized than those fixed relative to the listener's head, regardless of the fidelity of the individual impulse responses. Moreover, in prior art, the users lose control of the perceived spatial location of a remote, streamed sound object in relation to the local (non-streamed) sound objects captured by the hearing aids microphone.

Thus, it is an advantage of the present system that the user receives a binaural signal processed/spatialized according to user's own head related transfer function (HRTF) whereby the user can perceive where sound signals come from, and whereby the user can perceive if a signal moves.

The binaural hearing device comprises one or more sensors for measuring the orientation of the user's head. Thus, the hearing devices may be embedded with a magnetometer, optionally and/or other activity sensors, which is used to reliably determine the orientation of the hearing device wearer.

The external device, e.g. a spouse mic or a smartphone, is programmed to virtualize the captured sound based on the hearing device user's Head Related Transfer Functions (HRTF) or amplitude panning such as Vector-Base Amplitude Panning to provide a spatialized stereo signal to the pair of hearing devices based on the orientation of the hearing devices. The external device, e.g. a remote microphone, is considered as a point source, so that the hearing device user completely controls the rendition of the virtual sound.

The external device, e.g. spouse mic or smartphone, may be configured to receive the first orientation message that the hearing device user sends from the hearing devices when the user faces the location of the external device. This may be interpreted as a reference of zero-azimuthal degree for the use of HRTFs. The hearing devices may start to send the head movement and orientation information to the external device, e.g. configured as a streaming device, and may be configured to receive the streamed spatialized audio signals. When the user walks to a new spatial position relative to the external device, the user can initiate another orientation message, allowing the external device to update the perceived spatial location of the streamed audio signal.

This system provides a more naturally spatialized sound rendition compared to current un-spatialized systems and gives the user the ability to control the perceived location of the sound object, providing more natural acoustic cues to reflect the user's orientation relative to the external device.

In prior art, it is known to spatialize audio, such as in the audio industry, to improve listening experiences such as 3D sound and virtual auralization for gaming audio systems. These sound objects are typically pre-designed and their goal is mostly for leisure entertainment.

Thus, it is an advantage of one or more embodiments described herein that the processing the captured sounds at the distance from the user, i.e. by the external device, is based on the detected orientation of the user's head and the pre-determined head-related transfer functions (HRTF) for the user's left ear and right ear, for thereby providing a spatialized binaural audio signal in the user's hearing devices.

Thus, the present system provides a unique way for user to interact the virtualization of a remote source in the far-field captured by the external device with the sources in the near sound field captured by near-field microphones on hearing devices. In the present system, the virtualization of far-field sound sources is independent of the near-field source sources. The far-field sound sources are those in the far-field from the hearing device but near by the external device and captured by the external device, and the near-field sound sources are those near the user and captured by the hearing device microphones/input transducers. Thus, it is an advantage that the user can control the location of the remote source in relation to near field sources.

The system comprises a binaural hearing device configured to be worn by a user. The binaural device may be hearing aids for compensating for a hearing loss of the user. The compensation may be customized according to the frequency dependent hearing loss of the user. The elements or components of the binaural hearing device may be named with the prefix "first" or "left"/"right" in the following.

The binaural hearing device comprises one or more sensors for measuring the orientation of the user's head. The binaural hearing device comprises a first wireless communication unit for wireless communication with the external device, where the first wireless communication unit is configured for transmitting the orientation of the user's head to the external device.

The binaural hearing device may comprise a first antenna. The antenna may be configured for emission and reception of an electromagnetic field.

The binaural hearing device may comprise a first signal processor for processing sound signals.

The first wireless communication unit may be connected with the first antenna and with the first signal processor of the binaural hearing device.

The binaural hearing device further comprises a left hearing device configured to be worn in/at the left ear of the user, the left hearing device comprising a left output transducer configured for providing output audio signals in the left ear of the user.

The binaural hearing device further comprises a right hearing device configured to be worn in/at the right ear of the user, the right hearing device comprising a right output transducer configured for providing output audio signals in the right ear of the user.

The binaural hearing device may comprise a first input transducer for capturing sounds from the surroundings of the user. The binaural hearing device may comprise one or more first input transducers. The first input transducer(s) may be one or more microphones and/or one or more bone conduction vibration sensors.

The system comprises an external device configured to be arranged at a distance from the user. The external device may be or may comprise a spouse microphone or a smartphone. The external device is separate from the binaural hearing device. The external device is configured to be carried by another person who may move around. The external device may be placed in a location, e.g. a lectern or platform in room/school/church/conference room etc. The external device is configured to capture sounds coming from a remote sound source at the distance from the user. The remote sound source may be in the near-field of the external device. The remote sound source may be in the far-field of the binaural hearing device. The remote sound source may be any sound or audio signal near the external device and remote/at a distance but still in proximity from the user. The remote sound source may be the voice of the person carrying the external device. The remote sound source may be the voices of other persons who are close to the external device. The remote sound source may be music played close to the external device.

The elements or components of the external device may be named with the prefix "second" in the following.

The external device comprises a second wireless communication unit for wireless communication with the binaural hearing device, where the second wireless communication unit is configured for receiving the orientation of the user's head transmitted from the binaural hearing device.

The external device may comprise a second antenna. The antenna may be configured for emission and reception of an electromagnetic field.

The external device comprises a memory having stored pre-determined head-related transfer functions (HRTF) for the user's left ear and right ear, respectively.

The external device comprises a second input transducer for capturing sounds at the distance from the user. The sounds may be from a remote sound source. The remote sound source is remote from the user, i.e. at a distance from the user. The external device may be near the remote sound source. The second input transducer may be a microphone. The external device may comprise one or more second input transducers.

The external device comprises a second signal processor for processing the captured sounds at the distance from the user, wherein the processing is based on the received orientation of the user's head and the pre-determined head-related transfer functions (HRTF) for the user's left ear and right ear for providing a spatialized binaural audio signal.

It is an advantage that it is the external device which performs the processing of the captured sounds and not the binaural hearing device, because the external device may have more battery power and/or processing power than the binaural hearing device.

The second wireless communication unit may be connected with the second antenna and with the second signal processor of the external device.

The second wireless communication unit is configured for transmitting the spatialized binaural audio signal to the binaural hearing device.

The first wireless communication unit of the binaural hearing device is configured for receiving the spatialized binaural audio signal transmitted from the external device.

The spatialized binaural audio signal is provided in the left output transducer and in the right output transducer of the binaural hearing device.

This is an advantage for user because the user receives a binaural signal which is processed/spatialized according to user's own HRTF whereby the user can perceive where the signals come from and whereby the user can perceive if a signal moves.

The spatialized binaural audio signal may be two signals, one signal for the left output transducer and one signal for the right output transducer of the binaural hearing device.

A head-related transfer function (HRTF) also sometimes known as the anatomical transfer function (ATF) is a response that characterizes how an ear receives a sound from a point in space. As sound strikes the listener, the size and shape of the head, ears, ear canal, density of the head, size and shape of nasal and oral cavities, may all transform the sound and may affect how it is perceived, boosting some frequencies and attenuating others. Generally speaking, the HRTF may boost frequencies from 2-5 kHz with a primary resonance of +17 dB at 2,700 Hz. But the response curve may be more complex than a single bump, may affect a broad frequency spectrum, and may vary significantly from person to person.

A pair of HRTFs for two ears can be used to synthesize a binaural sound that seems to come from a particular point in space. It is a transfer function, describing how a sound from a specific point will arrive at the ear (generally at the outer end of the auditory canal).

Humans have just two ears, but can locate sounds in three dimensions—in range (distance), in direction above and below, in front and to the rear, as well as to either side. This is possible because the brain, inner ear and the external ears (pinna) work together to make inferences about location.

Humans estimate the location of a source by taking cues derived from one ear (monaural cues), and by comparing cues received at both ears (difference cues or binaural cues). Among the difference cues are time differences of arrival and intensity differences. The monaural cues come from the interaction between the sound source and the human anatomy, in which the original source sound is modified before it enters the ear canal for processing by the auditory system. These modifications encode the source location, and may be captured via an impulse response which relates the source location and the ear location. This impulse response is termed the head-related impulse response (HRIR). Convolution of an arbitrary source sound with the HRIR converts the sound to that which would have been heard by the listener if it had been played at the source location, with the listeners ear at the receiver location. The HRTF is the Fourier transform of HRIR.

HRTFs for left and right ear, expressed above as HRIRs, describe the filtering of a sound source (x(t)) before it is perceived at the left and right ears as xL(t) and xR(t), respectively.

The HRTF can also be described as the modifications to a sound from a direction in free air to the sound as it arrives at the eardrum. These modifications may include the shape of the listeners outer ear, the shape of the listeners head and body, the acoustic characteristics of the space in which the sound is played, and so on. All these characteristics will influence how (or whether) a listener can accurately tell what direction a sound is coming from.

For the present invention, the head-related transfer functions may be denoted as h_L(t) and h_R(t) for the left and right ear, respectively. Thus, sound perceived at the user's left ear is: XL(t)=x(t)*h_L(t), where x(t) is the sound source. And sound perceived at the user's right ear is: XR(t)=x(t)*h_R(t), where x(t) is the same sound source. Thereby, the head-related transfer functions h_L(t) and h_R(t) are rendering spatial cues of the source relative to the head orientation.

According to an aspect, disclosed is a method for audio rendering in a system. The system comprises a binaural hearing device configured to be worn by a user and an external device configured to be arranged at a distance from the user. The binaural hearing device comprises a left hearing device configured to be worn in/at the left ear of the user, the left hearing device comprising a left output transducer configured for providing output audio signals in the left ear of the user. The binarural hearing device comprises a right hearing device configured to be worn in/at the right ear of the user, the right hearing device comprising a right output transducer configured for providing output audio signals in the right ear of the user.

The method comprises:

measuring the orientation of the user's head by one or more sensors in the binaural hearing device;

transmitting the measured orientation of the user's head to the external device, by a first wireless communication unit in the binaural device configured for wireless communication with the external device;

receiving the transmitted orientation of the user's head, by a second wireless communication unit in the external device configured for wireless communication with the binaural hearing device;

obtaining stored pre-determined head-related transfer functions (HRTF) for the user's left ear and right ear, respectively, from a memory in the external device;

capturing sounds at the distance from the user by a second input transducer in the external device;

processing the captured sounds by a second signal processor in the external device, wherein the processing is based on the received orientation of the user's head and the pre-determined head-related transfer functions (HRTF) for the user's left ear and right ear for providing a spatialized binaural audio signal;

transmitting the spatialized binaural audio signal to the binaural hearing device by the second wireless communication unit;

receiving, by the first wireless communication unit of the binaural hearing device, the spatialized binaural audio signal transmitted from the external device, and providing the spatialized binaural audio signal in the left output transducer and in the right output transducer of the binaural hearing device.

In some embodiments, the system enables the user to perceive in which direction the captured sounds from the external device are coming from.

In some embodiments, the left hearing device and the right hearing device of the binaural hearing device each comprises one or more first input transducers for capturing input audio signals from the surroundings of the user; and wherein the binaural hearing device further comprises a first signal processor for processing audio signals.

In some embodiments, the first signal processor in the binaural hearing device is configured for mixing the received spatialized binaural audio signal from the external device with the input audio signals captured from the surroundings of the user by the one or more first input transducers in the left hearing device and the right hearing device.

It is an advantage that the user receives audio signals both from the left and right hearing devices of the binaural hearing device and from the external device.

In some embodiments, the one or more sensors, in the binaural hearing device, for measuring the orientation of the user's head is configured to continuously measure the orientation of the user's head, and wherein the first wireless communication unit, in the binaural hearing device, is configured for continuously transmitting the measured orientation of the user's head to the external device.

It is an advantage that the one or more sensors in the binaural hearing device measures the orientation of the user's head continuously, such as automatically, such as continually, such as constantly, such as at predetermined time intervals, such as every second etc.

It is an advantage that the first wireless communication unit in the binaural hearing device transmits the measured orientation of the user's head to the external device continuously, such as automatically, such as continually, such as constantly, such as at predetermined time intervals, such as every second etc.

Thereby the external device will be continuously updated on the orientation of the user's head, and the second wireless communication unit of the external device can thereby continuously transmit the spatialized binaural audio signal to the binaural hearing device.

In some embodiments, the binaural hearing device comprises a control component enabling the user of the binaural hearing device to manually provide/trigger that the measured orientation of the user's head is set as a reference orientation. The control component may e.g. be a push button on the binaural hearing device or voice activation via the one or more input transducers. There may be a predefined push/click pattern to set a reference orientation. The user may e.g. provide a long press or three fast clicks to manually provide/trigger that the current orientation is set a reference orientation.

In some embodiments, the setting of the reference orientation is configured to be initiated/performed when the user is facing the location of the external device.

In some embodiments, the spatialized binaural audio signal is further processed based on the reference orientation.

If no reference orientation is set or used in the processing, this may correspond to using a default reference such as 0 degree.

In some embodiments, the one or more sensors of the binaural hearing device are sensors configured for measuring an orientation of the user's head, and wherein the one or more sensors include a magnetometer, a gyroscope, and/or an accelerometer.

An accelerometer can tell the tilt relative to the earth's surface (2 axes) but not the heading. In theory, if you know where you were starting, you can add up acceleration to give you an estimate of position, but in practice, errors add up very quickly. But until they drift too far away from reality, you can use them for very high frame rate estimates of position.

A magnetometer can tell the heading if you hold it parallel to the ground. But combined with the tilt readings from a 3-axis accelerometer, you can get your heading regardless of how you're holding your device.

Gyros are great at giving rotational velocity but have no absolute reference. Again, if you know where you are pointing initially, you can get very high frame rate estimates of orientation. But it, too, drifts quickly.

In some embodiments, the measured orientation of the user's head is based on data relating to pitch and/or yaw and/or roll of the user's head.

The hearing device may be a headset, a hearing aid, a hearable etc. The hearing device may be an in-the-ear (ITE) hearing device, a receiver-in-ear (RIE) hearing device, a receiver-in-canal (RIC) hearing device, a microphone-and-receiver-in-ear (MaRIE) hearing device, a behind-the-ear (BTE) hearing device comprising an ITE unit, or a one-size-fits-all hearing device etc.

The hearing device is configured to be worn by a user. The hearing device may be arranged at the user's ear, on the user's ear, in the user's ear, in the user's ear canal, behind the user's ear etc. The user may wear two hearing devices, one hearing device at each ear. The two hearing devices may be connected, such as wirelessly connected.

The hearing device may be configured for audio communication, e.g. enabling the user to listen to media, such as music or radio, and/or enabling the user to perform phone calls. The hearing device may be configured for performing hearing compensation for the user. The hearing device may be configured for performing noise cancellation etc.

The hearing device may comprise a RIE unit. The RIE unit typically comprises the earpiece such as a housing, a plug connector, and an electrical wire/tube connecting the plug connector and earpiece. The earpiece may comprise an in-the-ear housing, a receiver, such as a receiver configured for being provided in an ear of a user, and an open or closed dome. The dome may support correct placement of the earpiece in the ear of the user. The RIE unit may comprise an input transducer e.g. a microphone or a receiver, an output trasducer e.g. an speaker, one or more sensors, and/or other electronics. Some electronic components may be placed in the earpiece, while other electronic components may be placed in the plug connector. The receiver may be with a different strength, i.e. low power, medium power, or high power. The electrical wire/tube provides an electrical connection between electronic components provided in the earpiece of the RIE unit and electronic components provided in the BTE unit. The electrical wire/tube as well as the RIE unit itself may have different lengths.

The hearing device may comprise an output transducer e.g. a speaker or receiver. The output transducer may be a part of a printed circuit board (PCB) of the hearing device.

The hearing device may comprise a first input transducer, e.g. a microphone, to generate one or more microphone output signals based on a received audio signal. The audio signal may be an analogue signal. The microphone output signal may be a digital signal. Thus, the first input transducer, e.g. microphone, or an analogue-to-digital converter, may convert the analogue audio signal into a digital microphone output signal. All the signals may be sound signals or signals comprising information about sound.

The hearing device may comprise a signal processor. The one or more microphone output signals may be provided to the signal processor for processing the one or more microphone output signals. The signals may be processed such as to compensate for a user's hearing loss or hearing impairment. The signal processor may provide a modified signal. All these components may be comprised in a housing of an ITE unit or a BTE unit. The hearing device may comprise a receiver or output transducer or speaker or loudspeaker. The receiver may be connected to an output of the signal processor. The receiver may output the modified signal into the user's ear. The receiver, or a digital-to-analogue converter, may convert the modified signal, which is a digital signal, from the processor to an analogue signal. The receiver may be comprised in an ITE unit or in an earpiece, e.g. RIE unit or MaRIE unit. The hearing device may comprise more than one microphone, and the ITE unit or BTE unit may comprise at least one microphone and the RIE unit may also comprise at least one microphone.

The hearing device signal processor may comprise elements such as an amplifier, a compressor and/or a noise reduction system etc. The signal processor may be implemented in a signal-processing chip or on the PCB of the hearing device. The hearing device may further have a filter function, such as compensation filter for optimizing the output signal.

The hearing device may comprise one or more antennas for radio frequency communication. The one or more antenna may be configured for operation in ISM frequency band. One of the one or more antennas may be an electric antenna. One or the one or more antennas may be a magnetic induction coil antenna. Magnetic induction, or near-field magnetic induction (NFMI), typically provides communication, including transmission of voice, audio and data, in a range of frequencies between 2 MHz and 15 MHz. At these frequencies the electromagnetic radiation propagates through and around the human head and body without significant losses in the tissue.

The magnetic induction coil may be configured to operate at a frequency below 100 MHz, such as at below 30 MHz, such as below 15 MHz, during use. The magnetic induction coil may be configured to operate at a frequency range between 1 MHz and 100 MHz, such as between 1 MHz and 15 MHz, such as between 1 MHz and 30 MHz, such as between 5 MHz and 30 MHz, such as between 5 MHz and 15 MHz, such as between 10 MHz and 11 MHz, such as between 10.2 MHz and 11 MHz. The frequency may further include a range from 2 MHz to 30 MHz, such as from 2 MHz to 10 MHz, such as from 2 MHz to 10 MHz, such as from 5 MHz to 10 MHz, such as from 5 MHz to 7 MHz.

The electric antenna may be configured for operation at a frequency of at least 400 MHz, such as of at least 800 MHz, such as of at least 1 GHz, such as at a frequency between 1.5 GHz and 6 GHz, such as at a frequency between 1.5 GHz and 3 GHz such as at a frequency of 2.4 GHz. The antenna may be optimized for operation at a frequency of between 400 MHz and 6 GHz, such as between 400 MHz and 1 GHz, between 800 MHz and 1 GHz, between 800 MHz and 6 GHz, between 800 MHz and 3 GHz, etc. Thus, the electric antenna may be configured for operation in ISM frequency band. The electric antenna may be any antenna capable of operating at these frequencies, and the electric antenna may be a resonant antenna, such as monopole antenna, such as a dipole antenna, etc. The resonant antenna may have a length of $\lambda/4\pm10\%$ or any multiple thereof, $\lambda$ being the wavelength corresponding to the emitted electromagnetic field.

The hearing device may comprise one or more wireless communications unit(s) or radios. The one or more wireless communications unit(s) are configured for wireless data communication, and in this respect interconnected with the one or more antennas for emission and reception of an electromagnetic field. Each of the one or more wireless communication unit may comprise a transmitter, a receiver, a transmitter-receiver pair, such as a transceiver, and/or a radio unit. The one or more wireless communication units may be configured for communication using any protocol as known for a person skilled in the art, including Bluetooth, WLAN standards, manufacture specific protocols, such as tailored proximity antenna protocols, such as proprietary protocols, such as low-power wireless communication protocols, RF communication protocols, magnetic induction protocols, etc. The one or more wireless communication units may be configured for communication using same communication protocols, or same type of communication protocols, or the one or more wireless communication units may be configured for communication using different communication protocols.

The wireless communication unit may connect to the hearing device signal processor and the antenna, for communicating with one or more external devices, such as one or more external electronic devices, including at least one smart phone, at least one tablet, at least one hearing accessory device, including at least one spouse microphone, remote control, audio testing device, etc., or, in some embodiments, with another hearing device, such as another hearing device located at another ear, typically in a binaural hearing device system.

The hearing device may be a binaural hearing device. The hearing device may be a first hearing device and/or a second hearing device of a binaural hearing device.

The hearing device may be a device configured for communication with one or more other device, such as configured for communication with another hearing device or with an accessory device or with a peripheral device.

The present disclosure relates to different aspects including the system, binaural hearing device, hearing devices, external device, and method described above and in the following, and corresponding device parts, each yielding one or more of the benefits and advantages described in connection with the first mentioned aspect, and each having one or more embodiments corresponding to the embodiments described in connection with the first mentioned aspect and/or disclosed in the appended claims.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
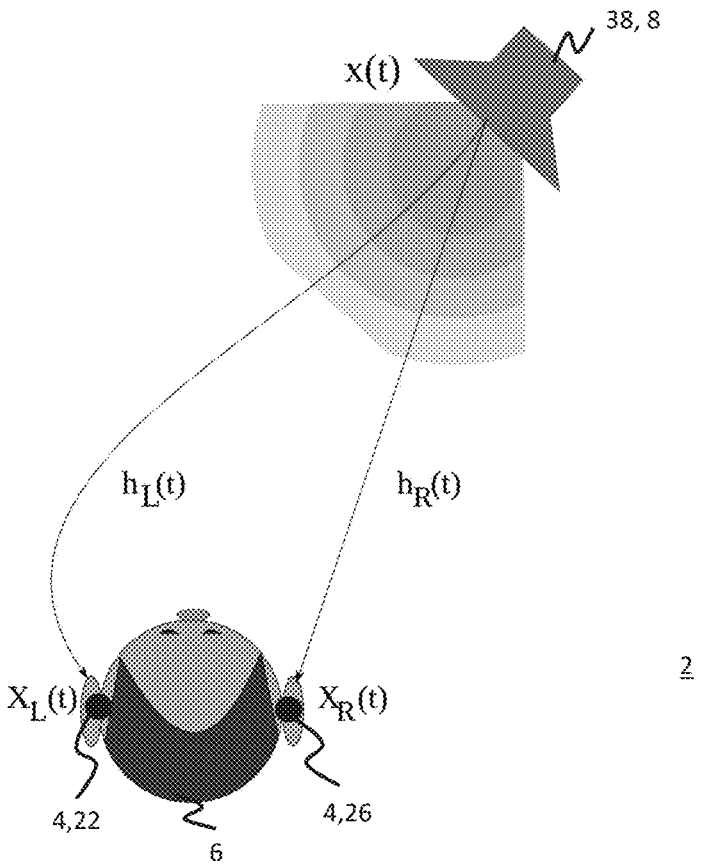
FIG. 1 schematically illustrates an exemplary system for audio rendering. The system comprises a binaural hearing device configured to be worn by a user. The system comprises an external device configured to be arranged at a distance from the user.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1 schematically illustrates an exemplary system for audio rendering. The system 2 comprises a binaural hearing device 4 configured to be worn by a user 6. The system 2 comprises an external device 8 configured to be arranged at a distance from the user 6.

The binaural hearing device 4 comprises one or more sensors 10 (not shown) for measuring the orientation of the user's head. The binaural hearing device 4 comprises a first wireless communication unit 12 (not shown) for wireless communication with the external device 8, where the first wireless communication unit 12 is configured for transmitting the orientation of the user's head to the external device 8.

The external device 8 comprises a second wireless communication unit 14 (not shown) for wireless communication with the binaural hearing device 4, where the second wireless communication unit 14 is configured for receiving the orientation of the user's head transmitted from the binaural hearing device 4.

The external device 8 comprises a memory 16 (not shown) having stored pre-determined head-related transfer functions (HRTF) hL(t), hR(t) for the user's left ear and right ear, respectively.

The external device 8 comprises a second input transducer 18 (not shown) for capturing sounds at the distance from the user 6. The sounds are from a remote sound source 38. The remote sound source 38 is remote from the user 6, i.e. at a distance from the user 6. The external device 8 is near the remote sound source 38.

The external device 8 comprises a second signal processor 20 (not shown) for processing the captured sounds at the distance from the user, wherein the processing is based on the received orientation of the user's head and the pre-determined head-related transfer functions (HRTF) for the user's left ear and right ear for providing a spatialized binaural audio signal.

The second wireless communication unit 14 (not shown) is configured for transmitting the spatialized binaural audio signal to the binaural hearing device 4.

The binaural hearing device 4 further comprises a left hearing device 22 configured to be worn in/at the left ear of the user, the left hearing device 22 comprising a left output transducer 24 configured for providing output audio signals in the left ear of the user.

The binaural hearing device 4 further comprises a right hearing device 26 configured to be worn in/at the right ear of the user, the right hearing device 26 comprising a right output transducer 28 configured for providing output audio signals in the right ear of the user.

The first wireless communication unit 12 (not shown) of the binaural hearing device 4 is configured for receiving the spatialized binaural audio signal transmitted from the external device 8.

The spatialized binaural audio signal is provided in the left output transducer 24 and in the right output transducer 28 of the binaural hearing device 4.

The head-related transfer functions may be denoted as h_L(t) and h_R(t) for the left and right ear, respectively. Thus, sound perceived at the user's left ear is: XL(t)=x(t)*h_L(t), where x(t) is the sound source. And sound perceived at the user's right ear is: XR(t)=x(t)*h_R(t), where x(t) is the same sound source. Thereby, the head-related transfer functions h_L(t) and h_R(t) are rendering spatial cues of the source relative to the head orientation.

Figure 2A:
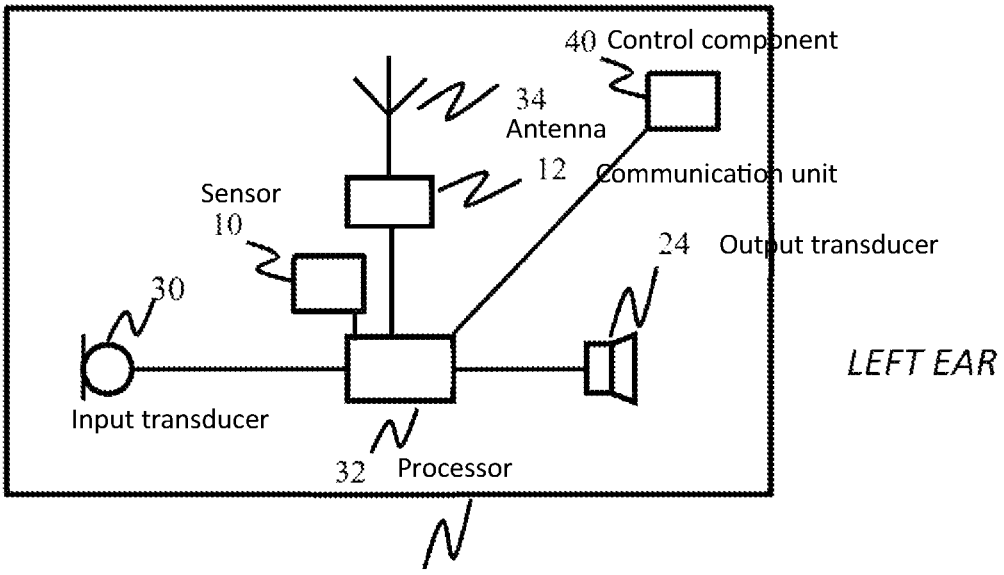
FIGS. 2*a* and 2*b* schematically illustrates an exemplary binaural hearing device comprising a left hearing device shown in FIG. 2*a*, and a right hearing shown in FIG. 2*b*.
Figure 2B:
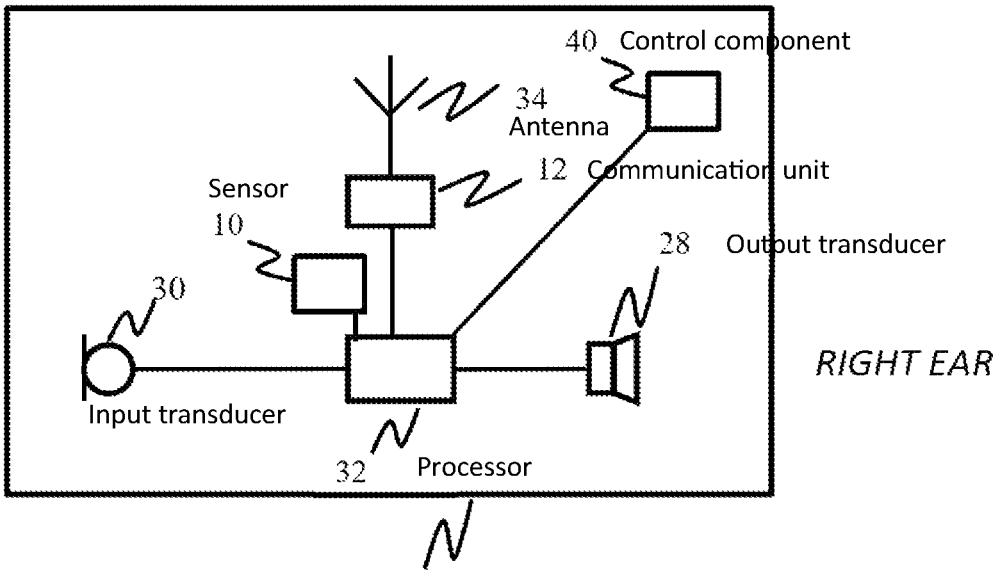

FIGS. 2*a* and 2*b* schematically illustrates an exemplary binaural hearing device comprising a left hearing device shown in FIG. 2*a*, and a right hearing shown in FIG. 2*b*.

FIG. 2*a* shows the binaural hearing device 4 comprising a left hearing device 22 configured to be worn in/at the left ear of the user, the left hearing device 22 comprising a left output transducer 24 configured for providing output audio signals in the left ear of the user.

FIG. 2*b* shows the binaural hearing device 4 comprising a right hearing device 26 configured to be worn in/at the right ear of the user, the right hearing device 26 comprising a right output transducer 28 configured for providing output audio signals in the right ear of the user.

The binaural hearing device 4 comprises one or more sensors 10 for measuring the orientation of the user's head. The binaural hearing device 4 comprises a first wireless communication unit 12 for wireless communication with the external device 8, where the first wireless communication unit 12 is configured for transmitting the orientation of the user's head to the external device 8.

The left hearing device 22 and the right hearing device 26 of the binaural hearing device 4 each comprises one or more first input transducers 30 for capturing input audio signals from the surroundings of the user.

The binaural hearing device 4 further comprises a first signal processor 32 for processing audio signals.

The first signal processor 32 in the binaural hearing device 4 is configured for mixing the received spatialized binaural audio signal from the external device 8 with the input audio signals captured from the surroundings of the user by the one or more first input transducers 30 in the left hearing device 22 and the right hearing device 26.

The binaural hearing device may comprise a first antenna 34. The first antenna 34 may be configured for emission and reception of an electromagnetic field.

The first wireless communication unit 12 may be connected with the first antenna 34 and with the first signal processor 32 of the binaural hearing device 4.

The binaural hearing device 4 may comprise a control component 40 enabling the user 6 of the binaural hearing device 4 to manually provide/trigger that the measured orientation of the user's head is set as a reference orientation. The control component 40 may e.g. be a push button on the binaural hearing device 4.

Some features are shown in both the left hearing device 22 and the right hearing device 26 of the binaural hearing device 4 in the FIGS. 2*a*) and 2*b*), and it is understood that some of these features may be present in both the left hearing device and the right hearing device, or that some of these features may only be present in one of the left hearing device or the right hearing device.

Figure 3:
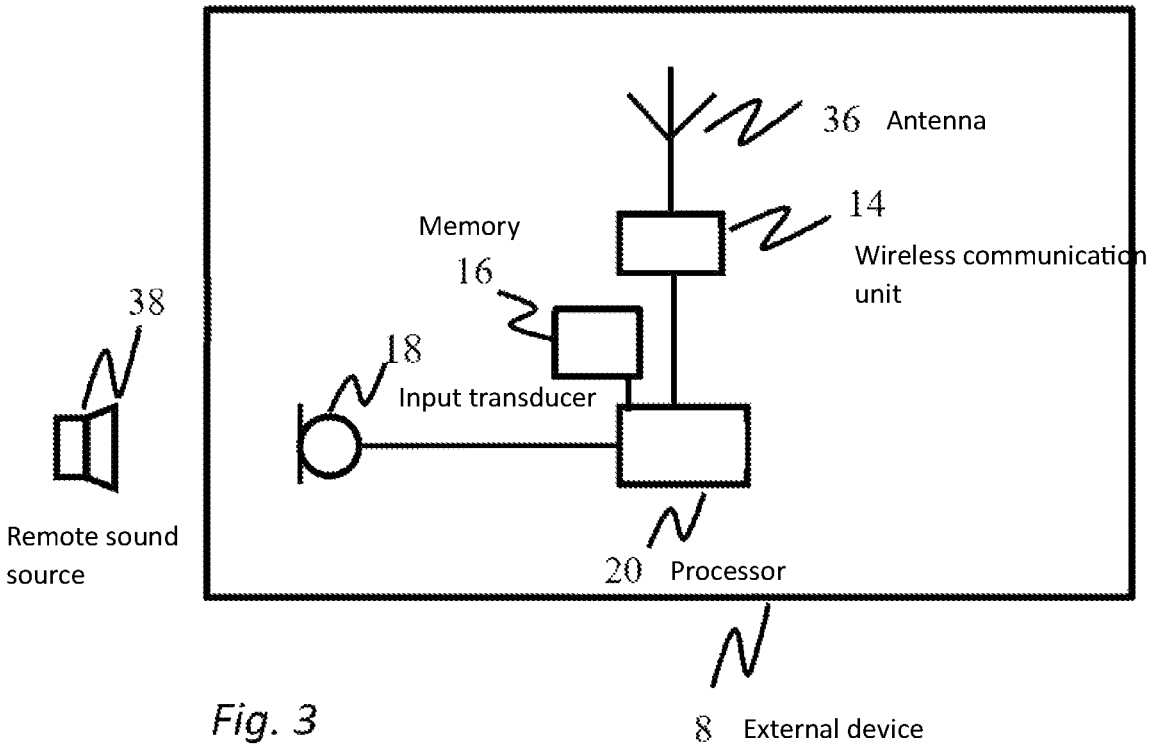
FIG. 3 schematically illustrates an exemplary external device of a system for audio rendering.

FIG. 3 schematically illustrates an exemplary external device 8 of a system for audio rendering. The system further comprises a binaural hearing device configured to be worn in/at the ear(s) of the user.

The external device 8 comprises a second wireless communication unit 14 for wireless communication with the binaural hearing device 4, where the second wireless communication unit 14 is configured for receiving the orientation of the user's head transmitted from the binaural hearing device.

The external device 8 comprises a memory 16 having stored pre-determined head-related transfer functions (HRTF) hL(t), hR(t) for the user's left ear and right ear, respectively.

The external device 8 comprises a second input transducer 18 for capturing sounds at the distance from the user. The sounds are from a remote sound source 38. The remote sound source 38 is remote from the user, i.e. at a distance from the user. The external device 8 is near the remote sound source 38.

The external device 8 comprises a second signal processor 20 for processing the captured sounds at the distance from the user, wherein the processing is based on the received orientation of the user's head and the pre-determined head-related transfer functions (HRTF) for the user's left ear and right ear for providing a spatialized binaural audio signal.

The external device 8 may comprise a second antenna 36. The second antenna 36 may be configured for emission and reception of an electromagnetic field.

The second wireless communication unit 14 may be connected with the second antenna 36 and with the second signal processor 20 of the external device 8.

The second wireless communication unit 14 is configured for transmitting the spatialized binaural audio signal to the binaural hearing device.

Figure 4:
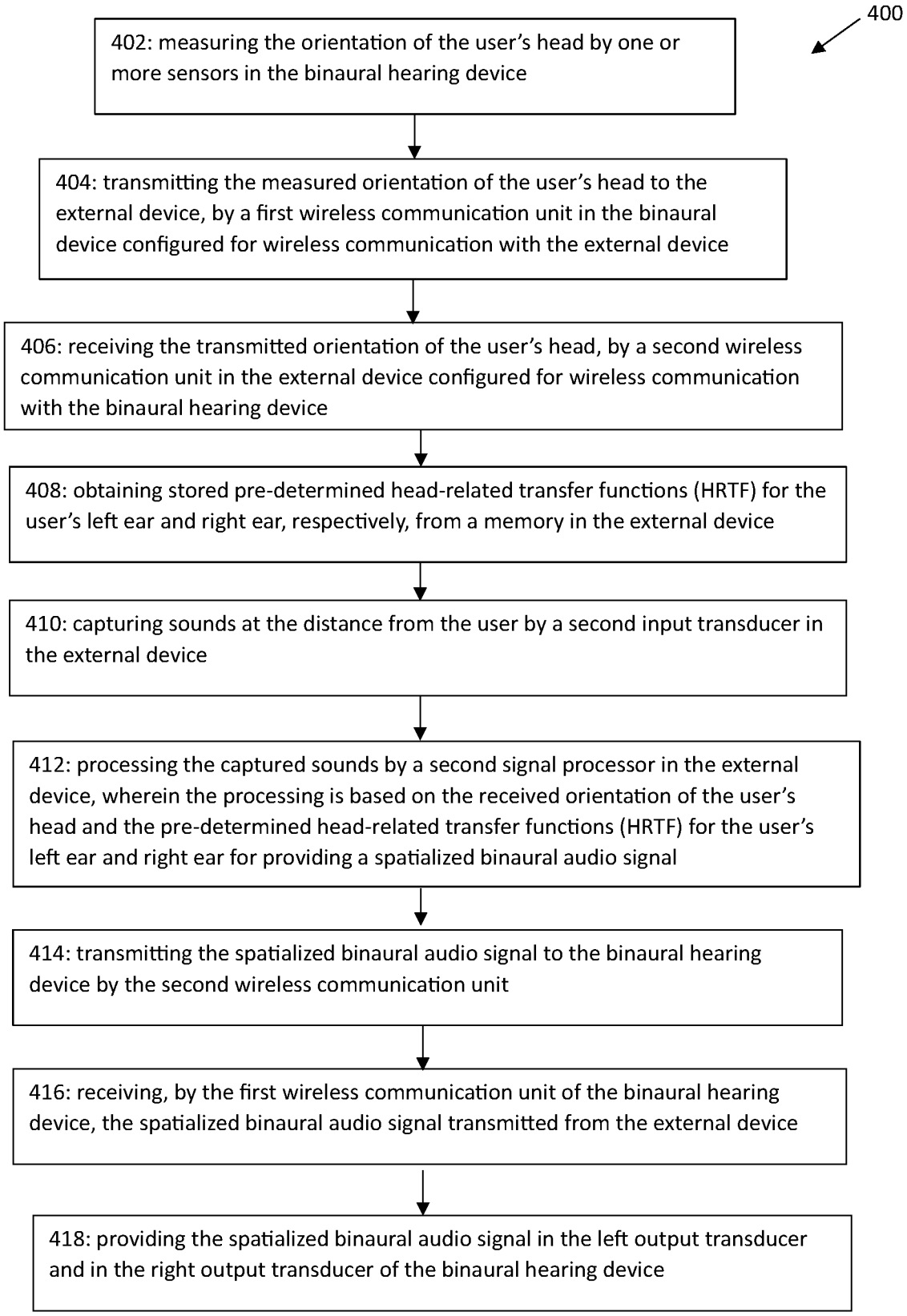
FIG. 4 schematically illustrates an exemplary method for audio rendering in a system.

FIG. 4 schematically illustrates an exemplary method for audio rendering in a system. The system comprises a binaural hearing device configured to be worn by a user and an external device configured to be arranged at a distance from the user. The binaural hearing device comprises a left hearing device configured to be worn in/at the left ear of the user, the left hearing device comprising a left output transducer configured for providing output audio signals in the left ear of the user. The binarural hearing device comprises a right hearing device configured to be worn in/at the right ear of the user, the right hearing device comprising a right output transducer configured for providing output audio signals in the right ear of the user.

The method 400 comprises:

measuring 402 the orientation of the user's head by one or more sensors in the binaural hearing device;

transmitting 404 the measured orientation of the user's head to the external device, by a first wireless communication unit in the binaural device configured for wireless communication with the external device;

receiving 406 the transmitted orientation of the user's head, by a second wireless communication unit in the external device configured for wireless communication with the binaural hearing device;

obtaining 408 stored pre-determined head-related transfer functions (HRTF) for the user's left ear and right ear, respectively, from a memory in the external device;

capturing 410 sounds at the distance from the user by a second input transducer in the external device;

processing 412 the captured sounds by a second signal processor in the external device, wherein the processing is based on the received orientation of the user's head and the pre-determined head-related transfer functions (HRTF) for the user's left ear and right ear for providing a spatialized binaural audio signal;

transmitting 414 the spatialized binaural audio signal to the binaural hearing device by the second wireless communication unit;

receiving 416, by the first wireless communication unit of the binaural hearing device, the spatialized binaural audio signal transmitted from the external device, and providing 418 the spatialized binaural audio signal in the left output transducer and in the right output transducer of the binaural hearing device.

Figure 5A:
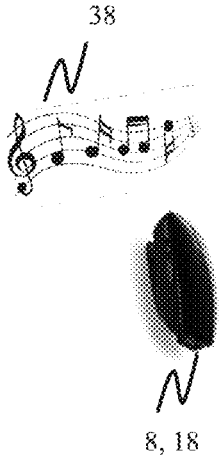
FIGS. 5*a*, 5*b* and 5*c* schematically illustrate setting a reference orientation.
Figure 5B:
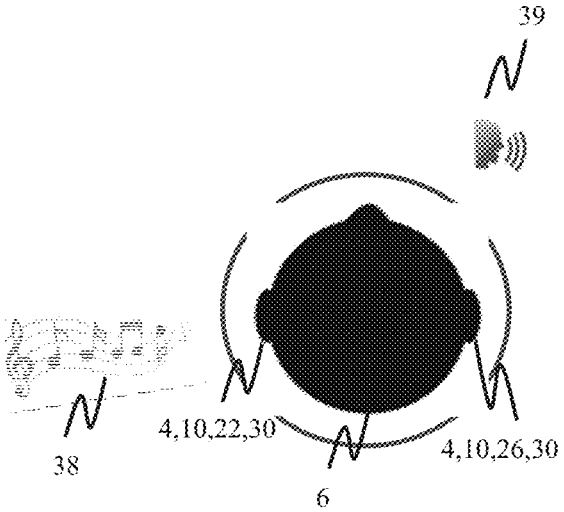
Figure 5C:
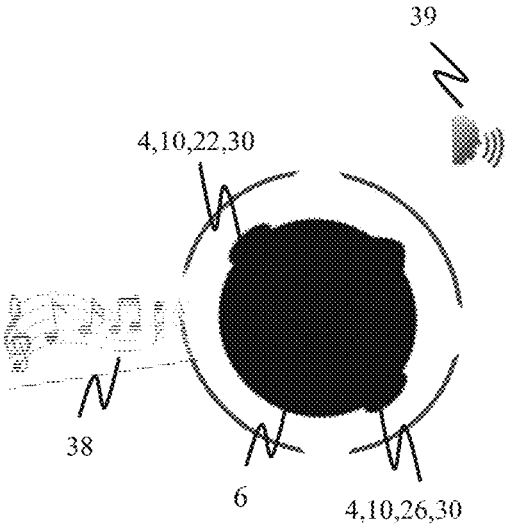

FIGS. 5*a*, 5*b* and 5*c* schematically illustrate setting a reference orientation.

The external device 8, e.g. a spouse mic or a smartphone, is programmed to virtualize the captured sound based on the hearing device user's 6 Head Related Transfer Functions (HRTF) or amplitude panning such as Vector-Base Amplitude Panning to provide a spatialized stereo signal to the pair of hearing devices 4, 22, 26 based on the orientation of the hearing devices 4, 22, 26. The external device 8, e.g. a remote microphone, is considered as a point source, so that the hearing device user 6 completely controls the rendition of the virtual sound.

The external device 8, e.g. spouse mic or smartphone, may be configured to receive the first orientation message that the hearing device user 6 sends from the hearing devices 4, 22, 26 when the user 6 faces the location of the external device 8. This may be interpreted as a reference of zero-azimuthal degree for the use of HRTFs. The hearing devices 4, 22, 26 may start to send the head movement and orientation information to the external device 8, e.g. configured as a streaming device, and may be configured to receive the streamed spatialized audio signals. When the user 6 walks to a new spatial position relative to the external device 8, the user 6 can initiate another orientation message, allowing the external device 8 to update the perceived spatial location of the streamed audio signal.

FIG. 5*a* shows the external device 8 comprising a second input transducer 18 for capturing sounds at the distance from the user. The sounds are from a remote sound source 38. The remote sound source 38 is remote from the user, i.e. at a distance from the user. The external device 8 is near the remote sound source 38.

FIG. 5*b* shows that the remote sound source 38 captured by the external device 8 is rendered in the user's 6 head, shown as at the left side of the user's 6 head, when the user 6 sets the reference orientation. The near sound source 39 is a sound source in the near-field of the user 6 which is captured by the input transducers 30 in the binaural hearing device 4, 22, 26.

FIG. 5*c* shows that the remote sound source 38 captured by the external device 8 is rendered in the user's 6 head, now shown as at the left back of the user's 6 head, when the user 6 changes his/her orientation. The near sound source 39 is a sound source in the near-field of the user 6 which is captured by the input transducers 30 in the binaural hearing device 4, 22, 26.

The one or more sensors 10, in the binaural hearing device 4, for measuring the orientation of the user's 6 head may be configured to continuously measure the orientation of the user's 6 head.

The first wireless communication unit, in the binaural hearing device 4, may be configured for continuously transmitting the measured orientation of the user's 6 head to the external device 8.

The binaural hearing device 4 may comprise a control component enabling the user 6 of the binaural hearing device 4 to manually provide/trigger that the measured orientation of the user's 6 head is set as a reference orientation.

The setting of the reference orientation may be configured to be initiated/performed when the user 6 is facing the location of the external device 8.

The spatialized binaural audio signal may be further processed based on the reference orientation.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

Items:

1. A system for audio rendering comprising a binaural hearing device configured to be worn by a user and an external device configured to be arranged at a distance from the user, wherein the binaural hearing device comprises:

one or more sensors for measuring the orientation of the user's head;

a first wireless communication unit for wireless communication with the external device, where the first wireless communication unit is configured for transmitting the orientation of the user's head to the external device;

wherein the external device comprises:

a second wireless communication unit for wireless communication with the binaural hearing device, where the second wireless communication unit is configured for receiving the orientation of the user's head transmitted from the binaural hearing device;

a memory having stored pre-determined head-related transfer functions (HRTF) for the user's left ear and right ear, respectively;

a second input transducer for capturing sounds at the distance from the user;

a second signal processor for processing the captured sounds at the distance from the user, wherein the processing is based on the received orientation of the user's head and the pre-determined head-related transfer functions (HRTF) for the user's left ear and right ear for providing a spatialized binaural audio signal;

wherein the second wireless communication unit is configured for transmitting the spatialized binaural audio signal to the binaural hearing device;

wherein the binaural hearing device further comprises:

a left hearing device configured to be worn in/at the left ear of the user, the left hearing device comprising a left output transducer configured for providing output audio signals in the left ear of the user;

a right hearing device configured to be worn in/at the right ear of the user, the right hearing device comprising a right output transducer configured for providing output audio signals in the right ear of the user;

wherein the first wireless communication unit of the binaural hearing device is configured for receiving the spatialized binaural audio signal transmitted from the external device, and wherein the spatialized binaural audio signal is provided in the left output transducer and in the right output transducer of the binaural hearing device.

2. The system according to any of the preceding items, wherein the system enables the user to perceive in which direction the captured sounds from the external device are coming from.

3. The system according to any of the preceding items, wherein the left hearing device and the right hearing device of the binaural hearing device each comprises one or more first input transducers for capturing input audio signals from the surrounding of the user; and wherein the binaural hearing device further comprises a first signal processor for processing audio signals.

4. The system according to any of the preceding items, wherein the first signal processor in the binaural hearing device is configured for mixing the received spatialized binaural audio signal from the external device with the input audio signals captured from the surrounding of the user by the one or more first input transducers in the left hearing device and the right hearing device.

5. The system according to any of the preceding items, wherein the one or more sensors, in the binaural hearing device, for measuring the orientation of the user's head is configured to continuously measure the orientation of the user's head, and wherein the first wireless communication unit, in the binaural hearing device, is configured for continuously transmitting the measured orientation of the user's head to the external device.

6. The system according to any of the preceding items, wherein the binaural hearing device comprises a control component enabling the user of the binaural hearing device to manually provide/trigger that the measured orientation of the user's head is set as a reference orientation.

7. The system according to any of the preceding items, wherein the setting of the reference orientation is configured to be initiated/performed when the user is facing the location of the external device.

8. The system according to any of the preceding items, wherein the spatialized binaural audio signal is further processed based on the reference orientation.

9. The system according to any of the preceding items, wherein the one or more sensors of the binaural hearing device are sensors configured for measuring an orientation of the user's head, and wherein the one or more sensors include a magnetometer, a gyroscope, and/or an accelerometer.

10. The system according to any of the preceding items, wherein the measured orientation of the user's head is based on data relating to pitch and/or yaw and/or roll of the user's head.

11. A method for audio rendering in a system, the system comprising a binaural hearing device configured to be worn by a user and an external device configured to be arranged at a distance from the user, the binaural hearing device comprising a left hearing device configured to be worn in/at the left ear of the user, the left hearing device comprising a left output transducer configured for providing output audio signals in the left ear of the user, and the binarural hearing device comprising a right hearing device configured to be worn in/at the right ear of the user, the right hearing device comprising a right output transducer configured for providing output audio signals in the right ear of the user, wherein the method comprises:

measuring the orientation of the user's head by one or more sensors in the binaural hearing device;

transmitting the measured orientation of the user's head to the external device, by a first wireless communication unit in the binaural device configured for wireless communication with the external device;

receiving the transmitted orientation of the user's head, by a second wireless communication unit in the external device configured for wireless communication with the binaural hearing device;

obtaining stored pre-determined head-related transfer functions (HRTF) for the user's left ear and right ear, respectively, from a memory in the external device;

capturing sounds at the distance from the user by a second input transducer in the external device;

processing the captured sounds by a second signal processor in the external device, wherein the processing is based on the received orientation of the user's head and the pre-determined head-related transfer functions (HRTF) for the user's left ear and right ear for providing a spatialized binaural audio signal;

transmitting the spatialized binaural audio signal to the binaural hearing device by the second wireless communication unit;

receiving, by the first wireless communication unit of the binaural hearing device, the spatialized binaural audio signal transmitted from the external device, and providing the spatialized binaural audio signal in the left output transducer and in the right output transducer of the binaural hearing device.

LIST OF REFERENCES

2 system
4 binaural hearing device
6 user
8 external device
10 sensors
12 first wireless communication unit of binaural hearing device
14 second wireless communication unit of external device
16 memory
hL(t), hR(t) head-related transfer functions (HRTF) for the user's left ear and right ear, respectively.
18 second input transducer of external device
20 second signal processor of external device
22 left hearing device
24 left output transducer
26 right hearing device
28 right output transducer
30 first input transducers of binaural hearing device
32 first signal processor of binaural hearing device
34 first antenna of binaural hearing device
36 second antenna of binaural hearing device
38 remote sound source
39 near sound source
40 control component
400 method
402 step of measuring the orientation of the user's head by one or more sensors in the binaural hearing device;
404 step of transmitting the measured orientation of the user's head to the external device, by a first wireless communication unit in the binaural device configured for wireless communication with the external device;
406 step of receiving the transmitted orientation of the user's head, by a second wireless communication unit in the external device configured for wireless communication with the binaural hearing device;
408 step of obtaining stored pre-determined head-related transfer functions (HRTF) for the user's left ear and right ear, respectively, from a memory in the external device;
410 step of capturing sounds at the distance from the user by a second input transducer in the external device;
412 step of processing the captured sounds by a second signal processor in the external device, wherein the processing is based on the received orientation of the user's head and the pre-determined head-related transfer functions (HRTF) for the user's left ear and right ear for providing a spatialized binaural audio signal;
414 step of transmitting the spatialized binaural audio signal to the binaural hearing device by the second wireless communication unit;
416 step of receiving, by the first wireless communication unit of the binaural hearing device, the spatialized binaural audio signal transmitted from the external device, and
418 step of providing the spatialized binaural audio signal in the left output transducer and in the right output transducer of the binaural hearing device.

The invention claimed is:

1. A system for audio rendering comprising a binaural hearing device configured to be worn by a user and an external device configured to be arranged at a distance from the user, wherein the binaural hearing device comprises:

a left output transducer configured for placement in a left ear of the user, a right output transducer configured for placement in a right ear of the user, one or more sensors for measuring an orientation of a head of the user, and a first wireless communication unit configured to wirelessly transmit a signal indicating the orientation of the head of the user to the external device;

wherein the external device comprises:

a second wireless communication unit configured to wirelessly receive the signal indicating the orientation of the head of the user transmitted from the binaural hearing device, a memory storing head-related transfer functions (HRTF) respectively for the left ear and the right ear of the user, an input transducer configured to capture sound at a distance from the user, and a processing unit configured to determine a spatialized binaural audio signal based on the captured sound, the orientation of the head of the user, and the head-related transfer functions (HRTF), wherein the second wireless communication unit is configured to transmit the spatialized binaural audio signal to the binaural hearing device;

wherein the binaural hearing device is configured to receive the spatialized binaural audio signal transmitted from the external device, and provide left audio output and right audio output via the left output transducer and the right output transducer, respectively, based on the spatialized binaural audio signal.

2. The system according to claim 1, wherein the system enables the user to perceive in which direction the captured sound from the external device is coming from.

3. The system according to claim 1, wherein the one or more sensors of the binaural hearing device are configured to continuously or repeatedly measure the orientation of the head of the user, and wherein the first wireless communication unit of the binaural hearing device is configured to continuously or repeatedly transmit the measured orientation to the external device.

4. The system according to claim 1, wherein the binaural hearing device comprises a control component for allowing the user of the binaural hearing device to set a reference orientation based on output from the one or more sensors.

5. The system according to claim 1, wherein the binaural hearing device is configured to set a reference orientation based on output from the one or more sensors when the user is facing the external device.

6. The system according to claim 1, wherein the processing unit is configured to provide the spatialized binaural audio signal also based on a reference orientation.

7. The system according to claim 1, wherein the one or more sensors of the binaural hearing device comprise a magnetometer, a gyroscope, and/or an accelerometer.

8. The system according to claim 1, wherein the measured orientation of the head of the user is based on data relating to pitch and/or yaw and/or roll of the head of the user.

9. The system according to claim 1, wherein the left output transducer is a part of a left hearing device of the binaural hearing device, and the right output transducer is a part of a right hearing device of the binaural hearing device.

10. The system according to claim 9, wherein the each of the left and right hearing devices comprises one or more hearing device input transducers for capturing sound in a surrounding of the user; and wherein the binaural hearing device is configured to process first output from the one or more hearing device input transducers of the left hearing device, and second output from the one or more hearing device input transducers of the right hearing device.

11. The system according to claim 10, wherein the binaural hearing device is configured to mix the spatialized binaural audio signal received from the external device with the first output from the one or more hearing device input transducers of the left hering device and/or with the second output from the one or more hearing device input transducers of the right hearing device.

12. An electronic device configured to communicate with a binaural hearing device, the electronic device comprising:

a wireless communication unit configured to wirelessly receive, from the binaural hearing device, a signal indicating an orientation of a head of a user of the binaural hearing device;

a memory storing head-related transfer functions (HRTF) respectively for a left ear and a right ear of the user;

an input transducer configured to capture sound at a distance from the user; and a processing unit configured to determine a spatialized binaural audio signal based on the captured sound, the orientation of the head of the user, and the head-related transfer functions (HRTF);

wherein the wireless communication unit is configured to transmit the spatialized binaural audio signal to the binaural hearing device for allowing the binaural hearing device to provide left and right audio outputs based on the spatialized binaural audio signal.

13. The electronic device according to claim 12, wherein the electronic device enables the user to perceive in which direction the captured sound is coming from.

14. The electronic device according to claim 12, wherein the wireless communication unit is configured to continuously or repeatedly receive the measured orientation from the binaural hearing device.

15. The electronic device according to claim 12, wherein the processing unit is configured to provide the spatialized binaural audio signal also based on a reference orientation.

16. The electronic device according to claim 15, wherein the reference orientation is set by the binaural hearing device.

17. The electronic device according to claim 15, wherein the reference orientation corresponds with a facing direction of the user of the binaural hearing device.

18. A binaural hearing device comprising:

a left output transducer configured for placement in a left ear of a user of the binaural hearing device;

a right output transducer configured for placement in a right ear of the user;

one or more sensors for measuring an orientation of a head of the user; and a wireless communication unit configured to wirelessly transmit a signal indicating the orientation of the head of the user to an external device;

wherein the binaural hearing device is configured to receive a spatialized binaural audio signal transmitted from the external device, and provide left audio output and right audio output via the left output transducer and the right output transducer, respectively, based on the spatialized binaural audio signal, and wherein the spatialized binaural audio signal is based on sound captured by the external device at a distance from the user, the orientation of the head of the user, and head-related transfer functions.

19. The binaural hearing device according to claim 18, wherein the left and right audio outputs allow the user to perceive in which direction the captured sound from the external device is coming from.

20. The binaural hearing device according to claim 18, wherein the one or more sensors of the binaural hearing device are configured to continuously or repeatedly measure the orientation of the head of the user, and wherein the wireless communication unit of the binaural hearing device is configured to continuously or repeatedly transmit the measured orientation to the external device.

21. The binaural hearing device according to claim 18, further comprising a control component for allowing the user of the binaural hearing device to set a reference orientation based on output from the one or more sensors.

22. The binaural hearing device according to claim 18, wherein the binaural hearing device is configured to set a reference orientation based on output from the one or more sensors when the user is facing the external device.

23. The binaural hearing device according to claim 18, wherein the spatialized binaural audio signal is also based on a reference orientation.

24. A method for audio rendering performed by a system, the system comprising (1) a binaural hearing device configured to be worn by a user and (2) an external device configured to be arranged at a distance from the user, the binaural hearing device comprising a left hearing device having a left output transducer, and a right hearing device having a right output transducer, wherein the method comprises:

measuring an orientation of a head of the user by one or more sensors in the binaural hearing device;

wirelessly transmitting a signal indicating the measured orientation to the external device;

wirelessly receiving the signal indicating the measured orientation by the external device;

obtaining head-related transfer functions (HRTF) for a left ear and a right ear, respectively, of the user from a memory of the external device;

capturing sound at the distance from the user by an input transducer of the external device;

determining a spatialized binaural audio signal based on the sound captured by the input transducer of the external device, the orientation of the head of the user, and the head-related transfer functions (HRTF);

transmitting the spatialized binaural audio signal to the binaural hearing device by the external device;

receiving, by the binaural hearing device, the spatialized binaural audio signal transmitted from the external device; and providing left audio output and right audio output via the left output transducer and the right output transducer, respectively, of the bianural hearing device based on the spatialized binaural audio signal.

* * * * *